United States Patent [19]

Kaye

[11] 4,367,404

[45] Jan. 4, 1983

[54] REDUCTION OF HYSTERESIS IN PHOTOMULTIPLIER DETECTORS

[75] Inventor: Wilbur I. Kaye, Corona Del Mar, Calif.

[73] Assignee: Beckman Instruments, Inc., Fullerton, Calif.

[21] Appl. No.: 165,530

[22] Filed: Jul. 3, 1980

[51] Int. Cl.[3] ..... H01J 40/14

[52] U.S. Cl. ..... 250/207; 313/105 R

[58] Field of Search ..... 250/207; 313/104, 105 R; 356/319; 328/242, 243

[56] References Cited

U.S. PATENT DOCUMENTS 3,614,646 10/1971 Hansen ..... 250/207

3,943,458 3/1976 Cohn ..... 250/207

3,997,779 12/1976 Rabl ..... 313/105 R

OTHER PUBLICATIONS

"Photomultiplier Tubes" Catalog of Hamamatsu TV Co., Ltd., Tokyo, Japan, Cat. No. SC-1-3, Rev. 2-1979.

*Primary Examiner*—David C. Nelms

*Attorney, Agent, or Firm*—R. J. Steinmeyer; Robert R. Meads; John R. Shewmaker

[57] ABSTRACT

Output current hysteresis exhibited by a multiple-dynode photomultiplier detector is reduced by inactivating one or more of the dynodes by shorting to the detector anode, and operating the detector with the reduced number of active dynodes while retaining the anode as the output current supply terminal.

6 Claims, 1 Drawing Figure

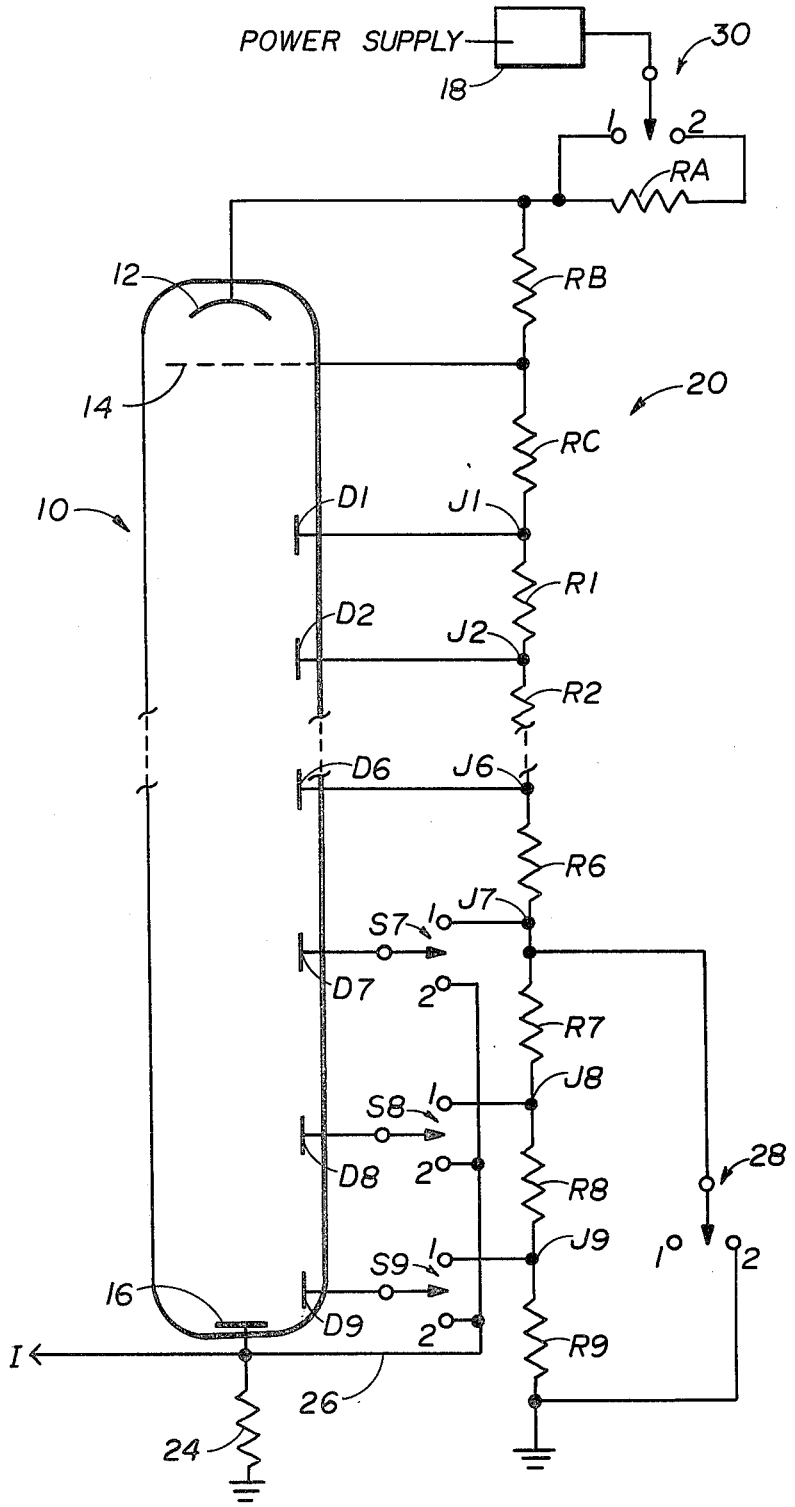
POWER SUPPLY
18
30
1
2
RA
12
RB
14
20
RC
10
D1
J1
R1
D2
J2
R2
D6
J6
R6
J7
S7
D7
R7
J8
S8
D8
R8
28
J9
S9
D9
R9
16
I
26
24

REDUCTION OF HYSTERESIS IN PHOTOMULTIPLIER DETECTORS

BACKGROUND OF THE INVENTION

1. Field of the Invention

The present invention relates generally to photomultiplier detectors and, more particularly, to the reduction of hysteresis in such detectors. The invention is particularly useful in applications, such as spectrophotometry, requiring linear sensitive detectors of low light levels.

2. Description of the Prior Art

Photomultipliers have found widespread use in applications requiring sensitive detectors of low light levels. In a photomultiplier detector light flux impinging on a photo-emissive cathode is converted into electrons released from the cathode. The electrons are directed at and cascade down a series of dynodes at each of which the number of electrons increases by a process called secondary emission. The multiplied number of electrons is ultimately collected at an anode and is measured as an electrical current. A photomultiplier is a very sensitive light detector since the gain or ratio of anode current to cathode current may be as high as $10^8$ or more.

The dynode or electron multiplying section of a photomultiplier detector comprises a plurality of dynodes in series. Insulating spacers support the dynodes and insulate each from one another and from other elements of the detector. A predetermined interdynode voltage is applied between each dynode and the next to cause the electrons to cascade from one dynode to the next toward the anode. The gain of the photomultiplier depends, in part, on the number of dynodes, the interdynode voltage between dynodes, and the electrostatic fields that channel the electrons from one dynode to the next.

A serious problem encountered in photomultiplier detectors is output current variation or hysteresis causing corresponding nonlinearity in the gain characteristic of the detector. A principal cause of such hysteresis is the unstable nature and erratic behavior of the electrostatic fields within the detector housing. In this regard, electrons scattered within the photomultiplier housing collect on the insulating spacers supporting the dynodes and on other elements or portions of the housing. The resulting electrostatic charge may continue to increase for periods from seconds to minutes and as it changes will effect similar changes in electrostatic focusing of the electrons from one dynode to the next. Moreover, the rate and equilibrium level of this charge buildup is a function of the light level striking the photocathode and the dynode voltage. These factors combine to cause the undesired variation or hysteresis in the output current and corresponding nonlinearity in the detector gain characteristic.

The problem of photomultiplier hysteresis has long plagued the field of spectrophotometry. Basically, many spectrophotometers employ a photomultiplier to measure the extent to which light is transmitted through or absorbed by a sample material of unknown characteristics. This measurement is compared with a corresponding transmittance or absorbance measurement of a reference material of known characteristics. Spectrophotometers for this purpose can be broadly categorized as double beam or single beam in design and operation. In a double beam spectrophotometer the sample material and the reference material are measured in rapid sequence in separate optical paths, the beams of light passing through the sample and through the reference are combined into a common beam, and this common beam is passed to a single photomultiplier detector. The detector output is demodulated to derive a signal indicating the difference between the sample and the reference measurements and hence indicating the desired sample measurement. Fortunately, in a double-beam spectrophotometer, the time constant for hysteresis of the detector gain is long relative to the time lapse between sample and reference measurements. Consequently, gain is equal for sample and reference readings and linearity is preserved. However, the price paid for this performance is the inherent design complexity and resulting higher costs inherent in the construction of a double-beam system.

In a single-beam spectrophotometer, on the other hand, the sample and the reference are measured at different times in the same optical path. As a result, a single beam instrument is particularly vulnerable to detector hysteresis since hysteresis alone will cause the detector output to change with time and light level introducing non-linearity. Because of the hysteresis problem, the art has not been able to capitalize on the relative design simplicity, lower noise level, and lower cost of a single-beam system, and many users have found it necessary to settle for the more costly and complex double-beam design.

Several solutions to photomultiplier detector hysteresis have been proposed in the past. In a first solution the exposed surface area of insulation is reduced within the detector housing to minimize the surface area available for the buildup of electrostatic charge. However, the insulation itself can only be reduced a finite amount before all elements of the detector are shorted out rendering the detector inoperative. In a second solution the insulating spacers are located as far as possible from the paths of electron travel between the dynodes. However, this expedient is limited in application since it requires fabrication of large and expensive photomultiplier housings. In addition to the above two solutions, it is known to employ "insulating" spacers exhibiting some degree of electrical conductivity. This prevents electrostatic charge buildup by conducting charge away through the spacers themselves. This arrangement has only limited hysteresis reduction capability in view of the fact that a leakage path exists between dynodes.

In another solution, exemplified by U.S. Pat. No. 3,943,458, one intermediate dynode is connected as the anode, and the remaining dynodes between it and the original anode are at least partially inactivated by connecting each and the original anode to a point in the dynode bias resistor chain between the intermediate dynode serving as the anode and the preceding active dynode. As a result it is possible for the inactivated dynodes to compete with the intermediate dynode (i.e. the new anode) for electrons emanating from the preceding active dynode. At high anode current levels especially, secondary electrons will leave the intermediate dynode/anode and collect on the inactive dynodes causing a nonlinearity between anode current and light intensity.

In view of the complexity and cost in the above approaches for reducing photomultiplier hysteresis, there are only a few relatively inexpensive so-called "low-hysteresis" photomultiplier detectors available. One of these is the type R928HA photomultiplier manufactured and sold by Hamamatsu TV Company, Ltd. In a publication of the manufacturer entitled "Hamamatsu Photomultiplier Tubes" dated February 1979 the subject of photomultiplier hysteresis in photometric applications is discussed in general at page 8 where it is stated that "Hysteresis may be a problem in applications such as photometry. To eliminate hysteresis, the ceramics on the top and bottom of the electrodes of Hamamatsu side-on types are coated with chromium and maintained at the cathode potential." The existence of a cathode potential adjacent to the (chargeable) insulator repulses electrons and they are therefore less inclined to collect on these insulators. The repulsion field increases with dynode voltage and at high voltages becomes quite effective in reducing hysteresis.

Unfortunately, efforts to incorporate the foreging R928HA photomultiplier into a single beam spectrophotometer were unsuccessful. It was found that an acceptable level of hysteresis could not be sustained across the full range of dynode voltage required to accommodate the different light levels to be measured. In this respect, to accommodate a maximum range of light levels, the photomultiplier gain is increased for low light levels and is decreased for higher light levels. The preferred method of adjusting the detector gain is by adjusting dynode voltage. However it was found that at low dynode voltages hysteresis was excessive. On the other hand, at high dynode voltages the hysteresis was acceptably low, but the detector gain was excessive. Excessive gain resulted in high anode current and other difficulties such as fatigue and non-linearity introduced by an unequal voltage developed between dynodes.

As a result, there is a need for a photomultiplier detector adopted for spectrophotometric systems exhibiting the desirable aspects of the prior detector, such as low cost, without the attendant disadvantages. The present invention meets these needs.

SUMMARY OF THE INVENTION

The present invention resides in a new and improved arrangement for minimizing hysteresis exhibited by a photomultiplier detector. Applicant has discovered that rendering one or more of the photomultiplier dynode(s) inactive by shorting the dynode(s) to the anode while retaining the anode as the output current supply terminal of the detector enables the detector to be operated across an acceptably wide range of gain at dynode voltage level for which the hysteresis exhibited by the detector is acceptable. Applicant has further discovered that reducing the number of active dynode forces a higher interstage voltage between the remaining active dynodes reducing hysteresis. For a given cathode voltage the interstage voltage increases while net gain decreases as the number of active dynodes is decreased. Thus a sufficiently high interstage voltage can be utilized to reduce hysteresis to an acceptable level without developing an unacceptably high anode current.

By virtue of the invention commercially available detectors, such as that discussed previously, exhibiting unacceptable hysteresis over a portion of the range of dynode voltage are modified in a manner enabling the detector to be operated with an acceptable low level of hysteresis across the requisite range of dynode voltage.

BRIEF DESCRIPTION OF THE DRAWING

The sole FIGURE is a schematic circuit diagram of a photomultiplier detector circuit arrangement in accordance with the present invention.

DESCRIPTION OF THE PREFERRED EMBODIMENTS

As shown in the drawing, for purposes of illustration, the present invention is embodied in a photomultiplier detector indicated generally by the numeral 10 having a photoemissive cathode 12, an optional control electrode 14, an electron multiplying section comprising nine dynodes $D_1$–$D_9$ and an anode 16. In the preferred embodiment, detector 10 is the commercially available R928HA photomultiplier discussed above manufactured and sold by Hamamatsu TV Company, Ltd. Operating voltages for the detector are supplied from a conventional power supply 18 of negative voltage across a voltage divider network 20 comprising a plurality of series connected resistive sections, identified as $R_A$, $R_B$, $R_C$ and $R_1$, $R_2$ . . . $R_9$. Each of dynodes $D_1$–$D_9$ is directly connected to a respective junction $J_1$–$J_9$ between the respective pair of resistive sections so that a predetermined dynode voltage is applied between each dynode and the next. Cathode 12 is operatively connected to the junction of resistive sections $R_A$ and $R_B$ while control electrode 14, is present, is connected to the junction of $R_B$ and $R_C$. The other terminal of the power supply, illustrated as a ground terminal, is connected to the opposite end of the voltage divider network (i.e. to $R_9$) and is connected through resistor 24 to anode 16.

As described to this point, the photomultiplier detector 10 is conventional in design and operation. Light flux to be measured impinges on cathode 12 releasing electrons therefrom which are directed toward and cascade down successive dynode stages $D_1$–$D_9$ at each of which electron multiplication by secondary emission takes place. The multiplied electrons are collected by anode 16 and an output current I is derived at the anode representing a greatly amplified measure of the light flux received by cathode 12. As indicated previously, detectors of this nature are subject to a time dependent change in gain or hysteresis for at least a portion of the range of dynode voltage. The resulting nonlinearity in gain restricts the usefulness of the detector.

In accordance with a primary aspect of the present invention one or more of the dynode stages is rendered inactive by shorting each such dynode to the anode 16 while retaining the anode as the output current supply terminal of the detector. By way of example, in the illustrated embodiment, three dynodes $D_7$, $D_8$, and $D_9$ out of the nine total dynodes are arranged to be so inactivated. To this end, three two-pole switches $S_7$, $S_8$, and $S_9$ are provided, the contact arms of which are connected to the respective dynodes $D_7$–$D_9$, the first poles of which are connected respectively to junctions $J_7$, $J_8$, and $J_9$ of the voltage divider network, and the second poles of which are each connected to anode 16 via conductor 26. In the first position of the switch contact arms, the dynodes $D_7$–$D_9$ are connected directly to the voltage divider network junctions $J_7$–$J_9$ to receive dynode voltage. In the second position of the contact arms, the supply of dynode voltage is removed from dynodes $D_7$–$D_9$ and, instead, these three dynodes are shorted via conductor 26 to the anode. As thus connected to the anode, the three dynodes are adapted to function as electron collectors.

In accordance with a further aspect of the invention the dynode voltage is removed from the inactivated dynodes while maintaining an equal distribution of voltage between dynodes and between dynode and anode. To this end a further switch 28 is connected across the three resistive sections $R_7$, $R_8$ and $R_9$ between junction $J_7$ and ground and a cooperating switch 30 is connected to power supply 18 and to one terminal or the other of resistor $R_A$. In a first position switch 28 establishes an open circuit across the three resistive sections, and in a second position establishes a short circuit thereacross. By shorting the sections in this manner, junction $J_7$ is coupled to the ground terminal effectively removing $R_7$–$R_9$ from the voltage divider network. Cooperating switch 30 is provided for inserting or removing resistor $R_A$ in series in the voltage divider network for controlling the current flow through and hence the voltage levels along the divider network. Switch 30 includes a contact arm coupled to the power supply 18 and first and second poles connected, respectively, to opposite ends of the first resistor $R_A$ in the voltage divider network. With this arrangement, in the second position of switch 30 resistive section $R_A$ is operatively inserted in series in the resistive network. In its first position switch 30 bypasses resistive section $R_A$ and couples the power supply to the junction between $R_A$ and $R_B$.

Significantly, the resistance value of resistive section $R_A$ is equal to the sum of the resistances of sections $R_7$, $R_8$, and $R_9$. Accordingly, by connecting resistive section $R_A$ into the divider network when sections $R_7$–$R_9$ are disconnected therefrom, and vice versa, the maximum interstage dynode voltage applied to remaining active dynodes $D_1$–$D_6$ is not increased beyond its rated value when dynodes $D_7$–$D_9$ are inactivated, and in fact the maximum inter-stage voltage remains at its normal value.

With the foregoing arrangement dynodes $D_7$–$D_9$ are inactivated by (1) switching each switch $S_7$–$S_9$ to position two thereby coupling the respective dynodes $D_7$–$D_9$ to anode 16; (2) closing switch 28 thereby coupling junction $J_7$ to ground; and (3) switching switch 30 to position two thereby inserting resistive section $R_A$ into divider network 20. Moreover anode 16 remains as the output current supply terminal. Reducing the number of active dynodes forces a higher interstage voltage between the remaining active dynodes reducing hysteresis. For a given cathode voltage the interstage voltage increases while net gain decreases as the number of active dynodes is decreased. Thus a sufficiently high interstage voltage can be utilized to reduce hysteresis to an acceptable level without developing an unacceptably high anode current. It has been found that the photomultiplier detector 10 can be operated in this configuration using only the remaining active dynodes $D_1$–$D_6$ across a wide range of gain over which an acceptably low level of hysteresis is exhibited. The gain is adjustable in a conventional manner (by means not shown) across this range by varying the level of dynode voltage supplied to the active dynodes enabling the photomultiplier to accommodate and measure low as well as high level light signals.

When very low light levels must be detected the switches can be placed at position one. Then all dynodes are active. This configuration will have acceptable hysteresis and acceptable anode current only when dynode voltage is high and hence can be used only when light level is very low.

While switches $S_7$–$S_9$, 28 and 30 have been illustrated as independent switches, it will be understood that they may be combined into a single two-position, five-pole switch conventional in the art. Moreover, it will be understood that switches $S_7$–$S_9$ could be replaced by hard wired connections connecting each of dynodes $D_7$–$D_9$ to anode 16. Similarly switch 28 could be replaced by a hard wired short circuit across the three resistive sections. Finally, the power supply could be wired directly to first resistive section $R_A$. As thus hard wired, the photomultiplier would not operate with its full complement of nine original dynodes and would have a lower dynamic range of gain.

While the photomultiplier detector has been illustrated as including nine dynodes three of which are shorted to the anode, it will be understood that the invention is applicable to photomultiplier detectors with any number of original dynodes and further that the number of dynodes which are selected to be shorted to the anode is a matter of choice depending upon the type of measurements being made and the environment in which the photomultiplier is to be operated. While a preferred embodiment of the invention has been illustrated and described, it will be understood that various modifications may be made therein without departing from the spirit and scope of the appended claims.

What is claimed is:

1. In a photomultiplier detector which generates an output current in response to incident light flux and includes (1) a photoemissive cathode emitting electrons in response to the incident light, (2) an electron multiplier section having a plurality and predetermined number of dynodes and means for applying dynode voltage between respective dynodes for effecting multiplication of the emitted electrons by secondary electron emission, and (3) an anode for collecting the multiplied electrons and at which the output current is derived, wherein the detector gain or ratio of output current to incident light flux depends at least in part on the number of dynodes and the value of dynode voltage within a range of dynode voltage and wherein for at least a portion of the range of dynode voltage the photomultiplier detector exhibits a time dependent change in gain or hysteresis introducing a nonlinearity in the output current, the improvement comprising:

means for inactivating at least one of the dynodes by shorting such dynode(s) to the anode enabling the inactive dynode(s) to function as an electron collector while retaining the anode as the output current supply terminal whereby the photomultiplier exhibits a reduced degree of hysteresis operating with the remaining number of active dynodes.

2. The detector of claim 1 wherein:

the inactivating means further operates to remove the supply of dynode voltage from the inactivated dynode(s) to prevent leakage of dynode voltage to the anode.

3. The detector of claim 2 further comprising:

means cooperating with the inactivating means to prevent a corresponding increase in the maximum interdynode voltage appliable to the remaining active dynodes.

4. The detector of claim 2 wherein the dynode voltage applying means comprises a network of resistive sections with junctions between sections connected to corresponding respective dynodes, a voltage source connected across the network and wherein the inactivating means further operates to remove at least one resistive section from the resistive network, the detector further comprising:

means cooperating with the inactivating means to compensate for the removed resistive section(s) by inserting a further resistive section into the network to thereby prevent a corresponding increase in the maximum inter dynode voltage appliable to the remaining active dynodes.

5. The detector of claim 4 wherein the resistance value of the inserted further resistive section substantially equals that of the removed resistive section(s).

6. The detector of claim 1 wherein the inactivating means inactivates a plurality of the dynodes by shorting such dynodes to the anode.

* * * * *